US007849963B1

(12) United States Patent
D'Agostino

(10) Patent No.: US 7,849,963 B1
(45) Date of Patent: Dec. 14, 2010

(54) LADDER CARRIER APPARATUS

(76) Inventor: Jonathan G. D'Agostino, 311 4th Ave., Halfmoon Bay, CA (US) 94019

( * ) Notice: Subject to any disclaimer, the term of this patent is extended or adjusted under 35 U.S.C. 154(b) by 0 days.

(21) Appl. No.: 12/248,688

(22) Filed: Oct. 9, 2008

(51) Int. Cl.
*A45F 3/02* (2006.01)

(52) U.S. Cl. ..... 182/129; 224/264; 224/265

(58) Field of Classification Search ..... 182/129; 224/201, 265, 266, 907
See application file for complete search history.

(56) References Cited

U.S. PATENT DOCUMENTS

| | | | | |
|---|---|---|---|---|
| 4,429,764 | A * | 2/1984 | Park | 182/129 |
| 5,058,789 | A | 10/1991 | Piper | |
| 5,207,364 | A | 5/1993 | Johnson | |
| 5,242,030 | A | 9/1993 | Lobozo | |
| 5,971,101 | A * | 10/1999 | Taggart | 182/129 |
| 6,189,752 | B1 | 2/2001 | Perry | |
| 6,193,012 | B1 | 2/2001 | Olivas | |
| 6,672,494 | B1 | 1/2004 | Fernandez | |
| 6,729,439 | B1 * | 5/2004 | Zlatis et al. | 182/129 |
| 2003/0047574 | A1 | 3/2003 | Horneman | |
| 2007/0084893 | A1 | 4/2007 | Godshaw et al. | |

OTHER PUBLICATIONS

Dictionary.com, "frame," in Dictionary.com Unabridged. Source location: Random House, Inc. http://dictionary.reference.com/browse/frame. Available: http://dictionary.reference.com. Accessed: Oct. 15, 2009. see final rejection for definition.*
<http://intermath.coe.uga.edu/dictnary/descript.asp?termID=74> see final rejection for definition.*

* cited by examiner

*Primary Examiner*—Katherine Mitchell
*Assistant Examiner*—Daniel Cahn
(74) *Attorney, Agent, or Firm*—Crossley Patent Law; Mark A. Crossley

(57) ABSTRACT

The ladder carrier apparatus provides a basic design for ladder carry with one end of the ladder angled upwardly. The apparatus provides for supporting a ladder's weight with a cushioned strap which is born on a carrier's shoulder. The apparatus is quickly affixed to or removed from a ladder.

1 Claim, 5 Drawing Sheets

LADDER CARRIER APPARATUS

BACKGROUND OF THE INVENTION

Ladders must in some way be carried to a desired use site, such as from a vehicle or storage facility to a surface or object to be reached. Yet carrying a ladder is typically a difficult task, especially as ladder size and length increases. A safer way to carry a ladder includes an angular carry whereby on end of the ladder is slanted upwardly. This decreases collisions with people and objects during ladder carry. Quite often a ladder is carried on one's shoulder, with the weight of the ladder typically born on the collar bone, an obviously less than desirable occurrence. What has been needed is a basically designed ladder carrier which provides for quick attachment and removal from a ladder. The ideal device should provide for upwardly angled carry of one end of the ladder. The ideal device should further provide comfortable, cushioned ladder carry. The present apparatus accomplishes these goals.

FIELD OF THE INVENTION

The ladder carrier apparatus relates to ladder carrying devices and more especially to a ladder carrier apparatus with L-shaped frame which is selectively affixed to a ladder and provides cushioned, angular carry upon a carrier's shoulder.

SUMMARY OF THE INVENTION

The general purpose of the ladder carrier apparatus, described subsequently in greater detail, is to provide a ladder carrier apparatus which has many novel features that result in an improved ladder carrier apparatus which is not anticipated, rendered obvious, suggested, or even implied by prior art, either alone or in combination thereof.

To attain this, the ladder carrier apparatus provides a basic design which is inexpensively produced and sold, as well as used. The L-shaped frame is provided in more than one material embodiment, which includes metal as well as synthetic materials. While the illustrated embodiment features u-clips which are removably affixed to the L-shaped frame, other embodiments provide permanent attachment, such as with rivets and other fasteners. The apparatus provides for ladder carry with one end of the ladder angled upwardly. The apparatus provides for supporting a ladder's weight with a cushioned strap which is born on a carrier's shoulder. The apparatus is quickly affixed to or removed from a ladder. The strap is affixed to the L-shaped frame by at least two strap fasteners per strap end, to ensure strength and durability.

Thus has been broadly outlined the more important features of the improved ladder carrier apparatus so that the detailed description thereof that follows may be better understood and in order that the present contribution to the art may be better appreciated.

An object of the ladder carrier apparatus is to be easily attached to and removed from a ladder.

Another object of the ladder carrier apparatus is to provide for an upward angle of one end of the ladder during carry.

A further object of the ladder carrier apparatus is to provide cushioned contact with the ladder carrier.

These together with additional objects, features and advantages of the improved ladder carrier apparatus will be readily apparent to those of ordinary skill in the art upon reading the following detailed description of presently preferred, but nonetheless illustrative, embodiments of the improved ladder carrier apparatus when taken in conjunction with the accompanying drawings.

In this respect, before explaining the current embodiments of the improved ladder carrier apparatus in detail, it is to be understood that the ladder carrier apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved ladder carrier apparatus. It is therefore important that the claims be regarded as including such equivalent constructions insofar as they do not depart from the spirit and scope of the ladder carrier apparatus. It is also to be understood that the phraseology and terminology employed herein are for purposes of description and should not be regarded as limiting.

DETAILED DESCRIPTION OF THE DRAWINGS

Figure 1:
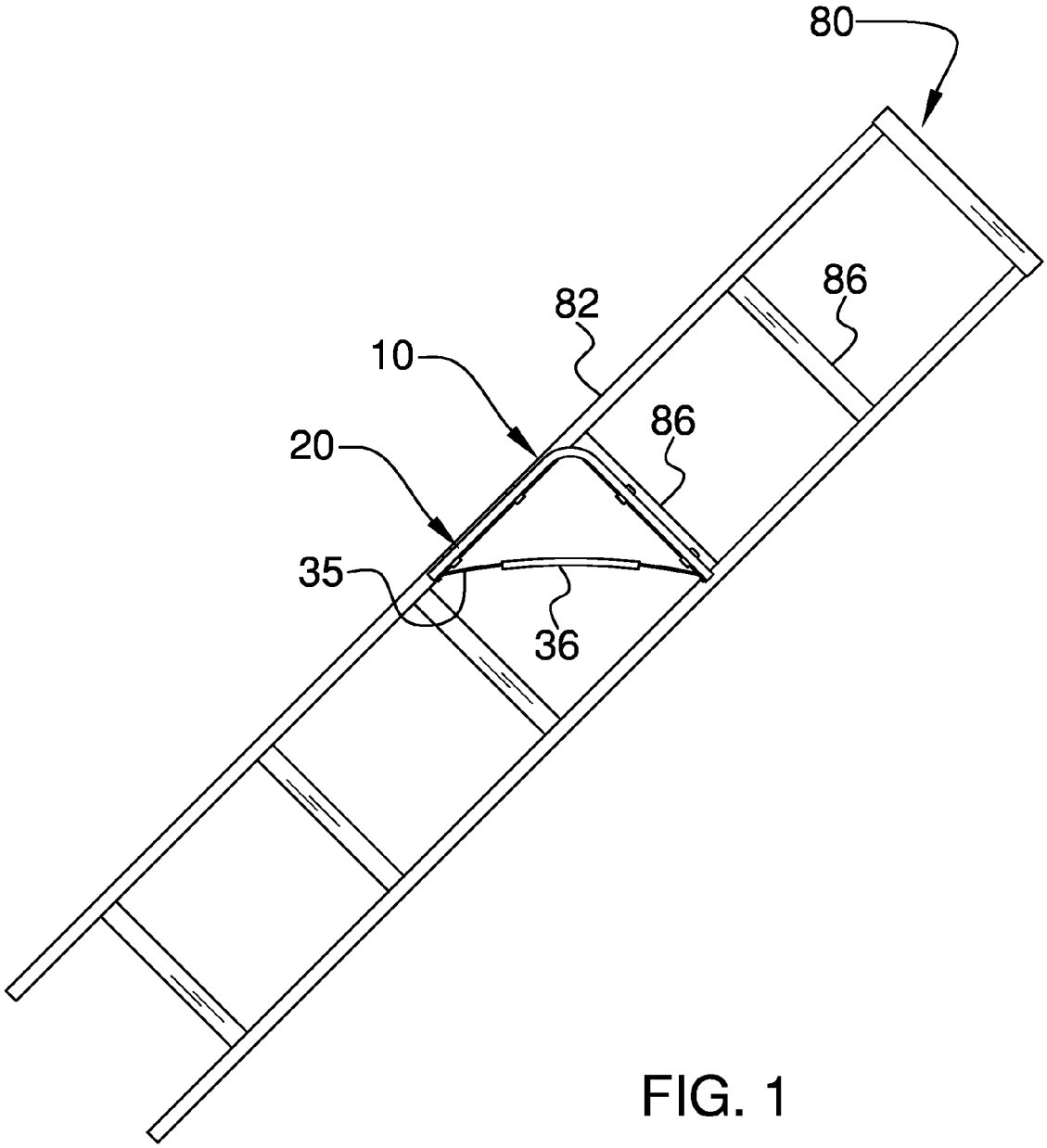
FIG. 1 is an elevation view of the apparatus attached to a ladder.

With reference now to the drawings, and in particular FIGS. 1 through 6 thereof, the principles and concepts of the ladder carrier apparatus generally designated by the reference number 10 will be described. Referring to FIG. 1, the ladder carrier apparatus 10 is selectively affixed to a typical ladder 80 having a pair of spaced apart rails 82 and a series of spaced apart support rungs 86 therebetween.

Figure 2:
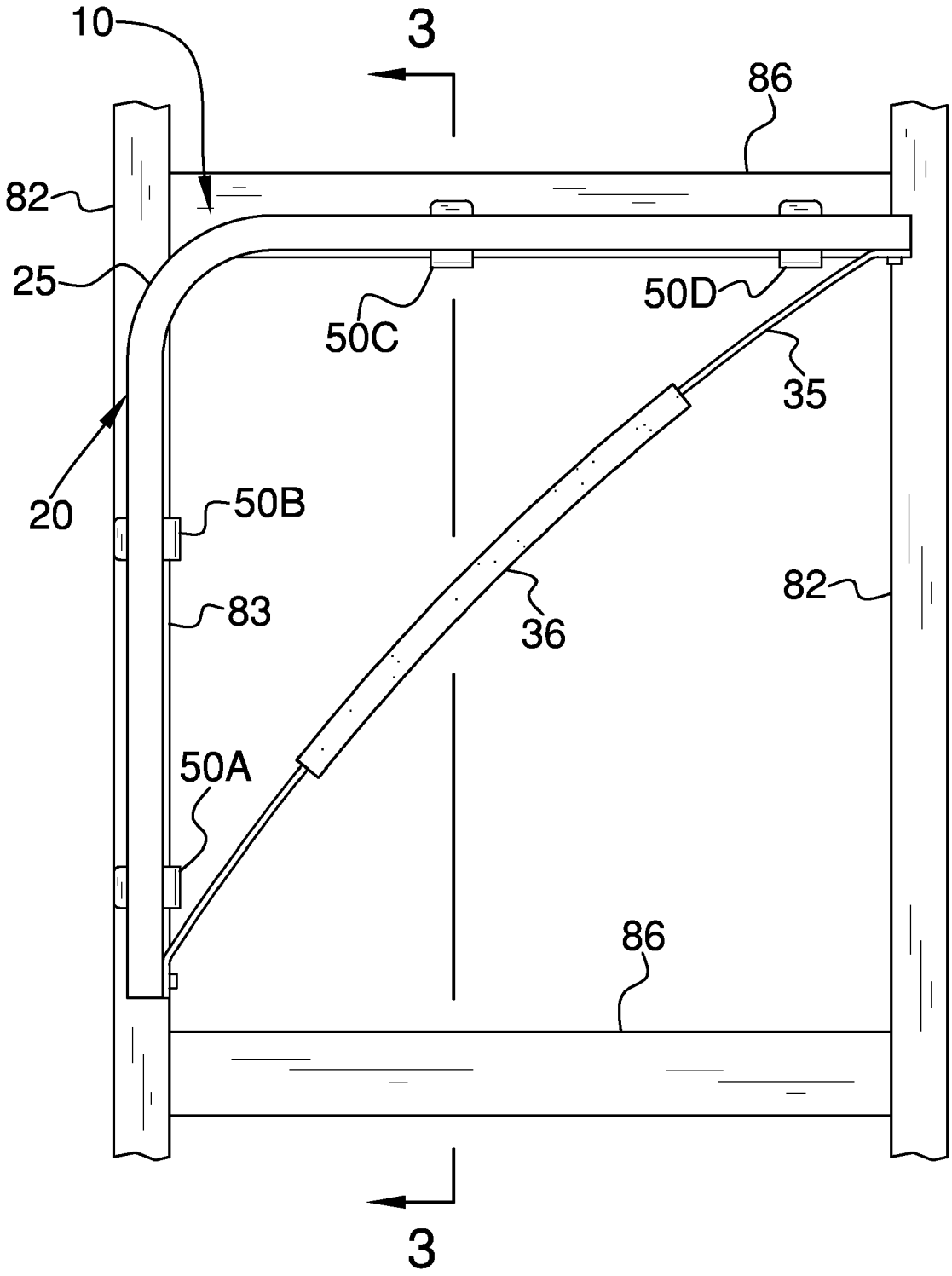
FIG. 2 is a front elevation view of the apparatus attached to the ladder rail and support rung.

Referring to FIG. 2, the u-clips are comprised of the first u-clip 50*a*, the second u-clip 50*b*, the third u-clip 50*c*, and the fourth u-clip 50*d*. The first u-clip 50*a* and second u-clip 50*b* are removably affixed to a rail edge 83 of a rail 82 of the existing ladder 80. The third u-clip 50*c* and the fourth u-clip 50*d* are removably affixed to the support rung 86 of the existing ladder 80.

Figure 3:
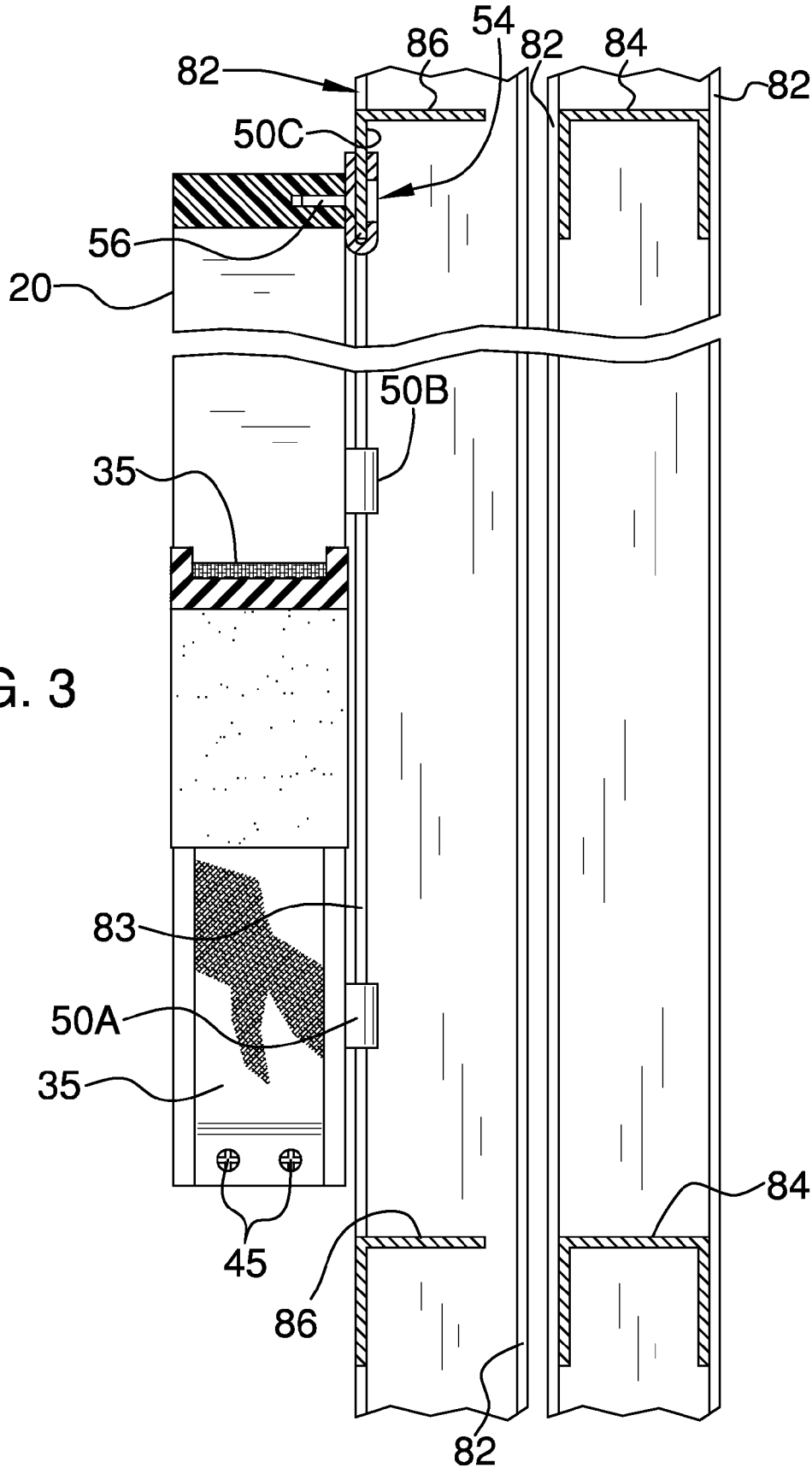
FIG. 3 is a cross sectional view of FIG. 2, taken along the line 3-3.

Referring to FIG. 3, the apparatus 10 is affixed to the ladder 80 having a pair of spaced apart rails 82 on each side of the existing typical step ladder 80. One side of the step ladder 80 has a series of spaced apart steps 84. One side of the folding step ladder 80 has a series of spaced apart support rungs 86 between a pair of spaced apart rails 82. Each rail 82 has a rail edge 83. The first u-clip 50*a* and the second u-clip 50*b* removably attach to the rail edge 83. The third u-clip 50*c* is removably attached to the support rung 86.

Figure 4:
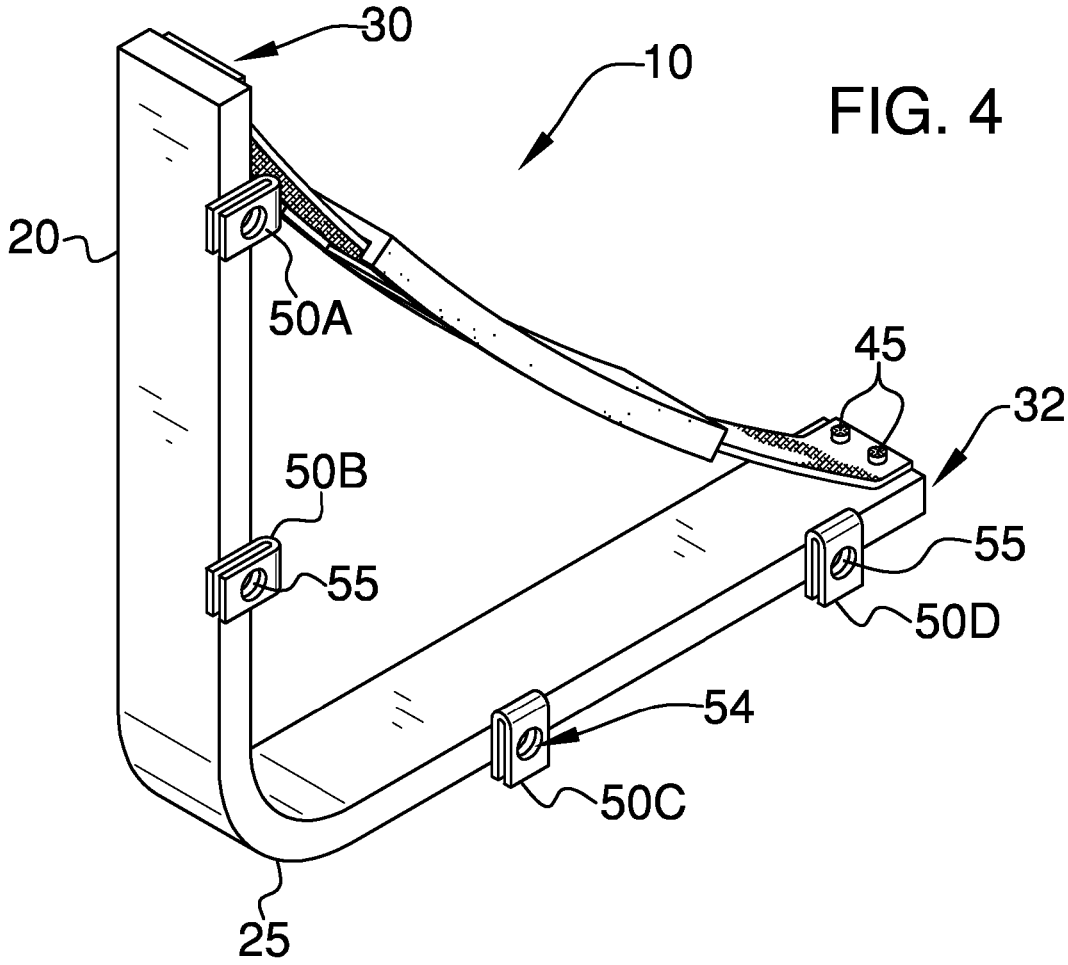
FIG. 4 is a perspective view of the apparatus.
Figure 5:
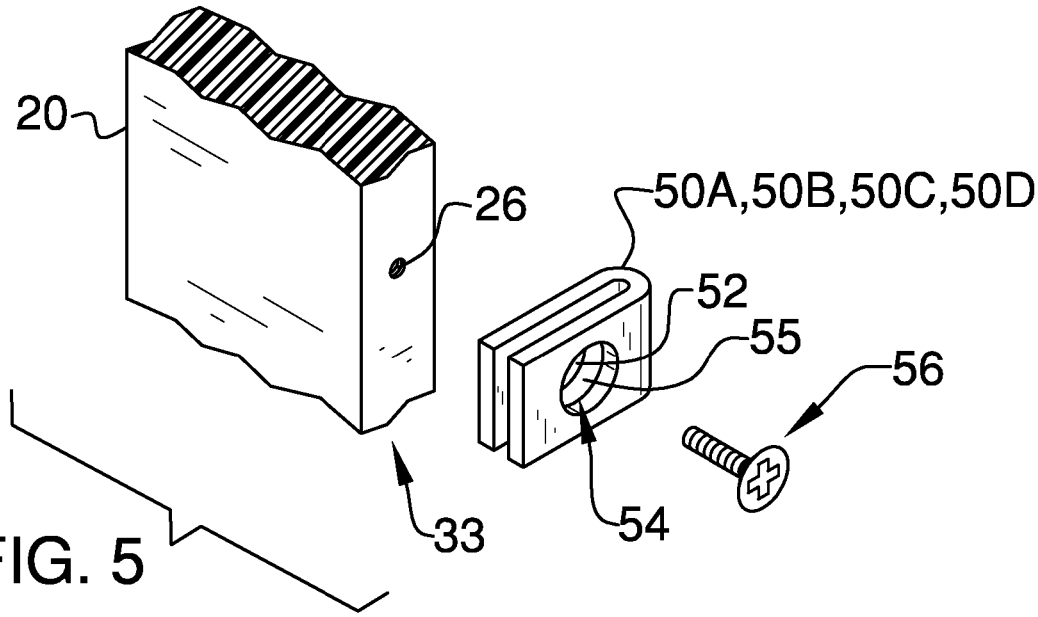
FIG. 5 is a perspective view of the u-clip to frame attachment features.
Figure 6:
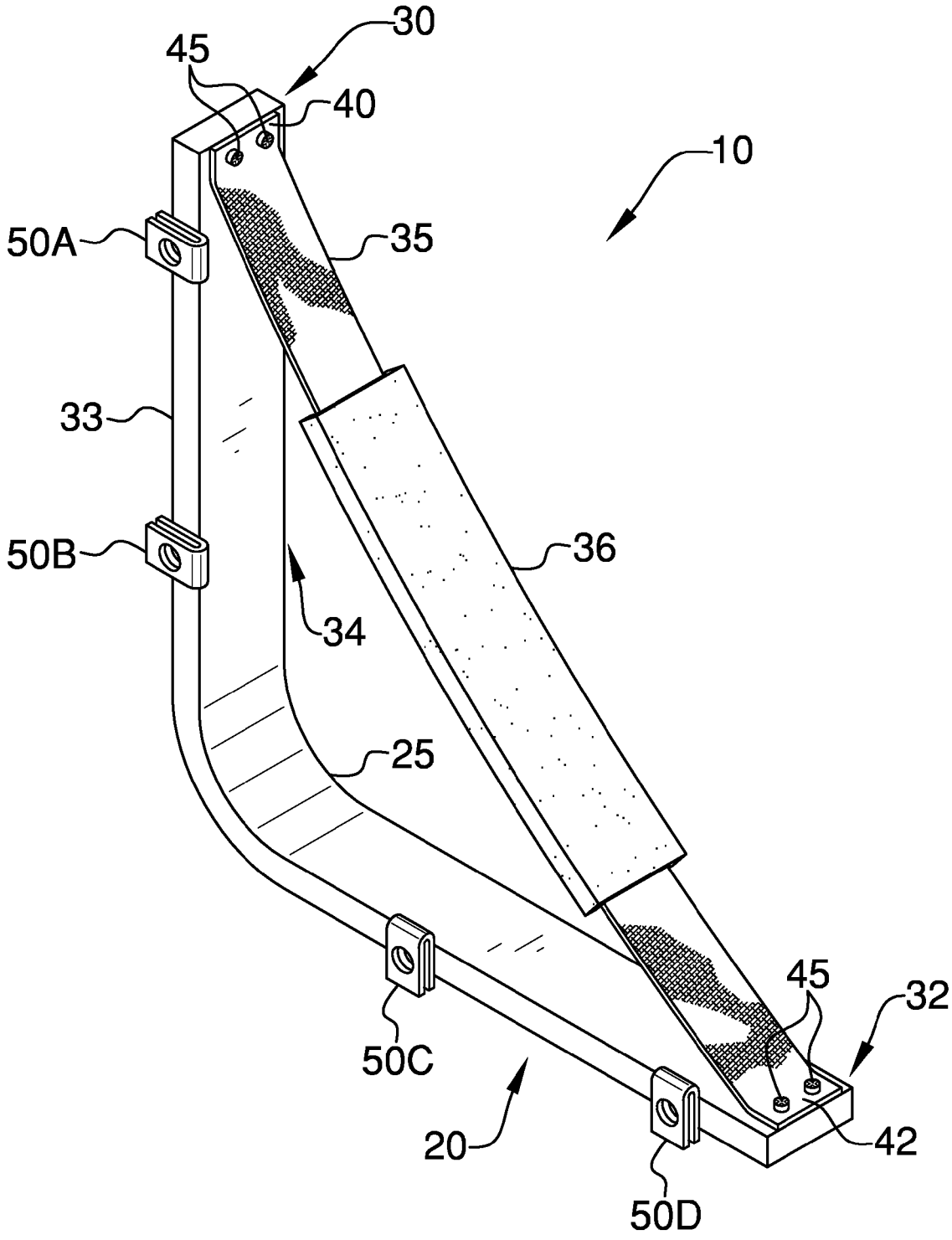
FIG. 6 is a perspective view.

Referring to FIGS. 4, 5, and 6, the apparatus 10 further comprises the rigid L-shaped frame 20. The L-shaped frame 20 has a first side 33, a second side 34, a first end 30, and a second end 32. The rounded corner 25 is disposed between the frame 20 first end 30 and second end 32. The rounded corner 25 ensures that the apparatus 10 has no conflict in fit to the existing ladder 80. The plurality of frame orifices 26 is disposed within the frame 20 first side 33. The strap 35 connects the frame 20 first end 30 to the frame 20 second end 32. The strap first end 40 is affixed to the frame 20 first end 30. The strap second end 42 is affixed to the frame 20 second end 32. The strap 35 is affixed via strap fasteners 45. The cushion 36 is affixed around at least a portion of the strap 35. The cushion 36 is not limited to the length illustrated. Each of the u-clips affixed to the L-shaped frame 20 further comprises a first orifice 52 spaced apart from a second orifice 54. The tapered seat 55 is disposed within the first orifice 52. A plurality of tapered head fasteners 56 is provided. One of each of the tapered head fasteners 56 is removably inserted through the first orifice 52 and second orifice 54 of each u-clip. Each tapered head fastener 56 is removably inserted into a frame orifice 26 of the frame 20.

With respect to the above description then, it is to be realized that the optimum dimensional relationships for the parts of the ladder carrier apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the ladder carrier apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the ladder carrier apparatus may be used.

Therefore, the foregoing is considered as illustrative only of the principles of the ladder carrier apparatus. Further, since numerous modifications and changes will readily occur to those skilled in the art, it is not desired to limit the ladder carrier apparatus to the exact construction and operation shown and described, and accordingly, all suitable modifications and equivalents may be resorted to, falling within the scope of the ladder carrier apparatus.

What is claimed is:

1. A ladder carrier apparatus in combination with a ladder, the ladder carrier apparatus, comprising:

a rigid L-shaped frame having a first side, a second side, a first end and a second end, the rigid frame further having a rounded corner between and directly connecting the first end to the second end;

a plurality of frame orifices disposed within the frame first side;

a strap connecting the frame first end to the frame second end, a strap first end affixed to the frame first end, a strap second end affixed to the frame second end, the strap affixed via strap fasteners;

a cushion affixed around at least a portion of the strap;

a plurality of u-clips affixed to the L-shaped frame, the u-clips comprising a first u-clip, a second u-clip, a third u-clip, and a fourth u-clip, each u-clip further comprising:

a first orifice spaced apart from a second orifice;

a tapered seat disposed within the first orifice;

a tapered head fastener removably inserted through the first orifice and second orifice of each u-clip, each tapered head fastener removably inserted into a respective frame orifice of said plurality of frame orifices of the frame;

the first u-clip and second u-clip removably affixed to a rail of the ladder;

the third u-clip and fourth u-clip removably affixed to a support rung of the ladder, the L-shaped frame disposed co-planar with the rail and support rung.

* * * * *